US011708199B1

(12) United States Patent
Sawyer et al.

(10) Patent No.: US 11,708,199 B1
(45) Date of Patent: Jul. 25, 2023

(54) ONE TIME USE BOTTLE

(71) Applicants: Duane Sawyer, York, PA (US); Bob Holmes, York, PA (US)

(72) Inventors: Duane Sawyer, York, PA (US); Bob Holmes, York, PA (US)

(73) Assignee: Quicky Sippy LLC, York, PA (US)

( * ) Notice: Subject to any disclaimer, the term of this patent is extended or adjusted under 35 U.S.C. 154(b) by 0 days.

(21) Appl. No.: 15/231,685

(22) Filed: Aug. 8, 2016

Related U.S. Application Data

(63) Continuation-in-part of application No. 14/818,888, filed on Aug. 5, 2015.

(51) Int. Cl.

| | |
|---|---|
| ***B65D 51/22*** | (2006.01) |
| ***A61J 9/00*** | (2006.01) |
| ***B65B 3/04*** | (2006.01) |
| ***B65B 7/28*** | (2006.01) |
| ***B65D 1/02*** | (2006.01) |
| ***B65D 41/04*** | (2006.01) |
| ***B65D 47/06*** | (2006.01) |

(52) U.S. Cl.
CPC ..... *B65D 51/222* (2013.01); *A61J 9/00* (2013.01); *B65B 3/04* (2013.01); *B65B 7/2835* (2013.01); *B65D 1/0246* (2013.01); *B65D 41/04* (2013.01); *B65D 47/06* (2013.01); *B65D 2251/009* (2013.01); *B65D 2251/0015* (2013.01); *B65D 2251/0025* (2013.01); *B65D 2251/0028* (2013.01); *B65D 2251/0093* (2013.01)

(58) Field of Classification Search
CPC .... B65D 51/222; B65D 51/22; B65D 51/221; B65D 2251/0015; B65D 2251/0093; B65D 5/747; B65D 51/243; B65D 51/2835; B65D 51/285; B65D 41/0471; B65D 55/02
USPC ..... 215/344
See application file for complete search history.

(56) References Cited

U.S. PATENT DOCUMENTS

| | | | | |
|---|---|---|---|---|
| 5,477,972 | A * | 12/1995 | Lester | B65D 51/222 215/230 |
| 5,494,174 | A | 2/1996 | Rohr | |
| 5,690,241 | A * | 11/1997 | Montgomery | B65D 41/0471 215/235 |
| 6,182,822 | B1 * | 2/2001 | Albisetti | B65D 25/087 206/221 |
| 9,637,290 | B2 * | 5/2017 | Jeon | B65D 51/285 |
| 2014/0083879 | A1 * | 3/2014 | Ulstad | B65D 51/225 206/222 |

(Continued)

OTHER PUBLICATIONS

Office Action in U.S. Appl. No. 15/683,771 (continuation in part of current application), dated Mar. 21, 2019.

*Primary Examiner* — Shawn M Braden
(74) *Attorney, Agent, or Firm* — Muskin and Farmer LLC

(57) ABSTRACT

A one-time use bottle. The bottle is filled with a drinkable liquid and then a liner is sealed on top of the bottle. A lid contains lid assembly threads which cooperate with neck assembly threads located on the neck of the bottle which enable the lid to be screwed onto the bottle in a sealed position. The lid also contains lid opening threads which cooperate with neck opening threads located on the neck of the bottle which enable the lid to be screwed into the neck further thereby cutting into the liner and exposing the drinkable liquid. The drinkable liquid can now be drank via a spout in the lid. The lid cannot be removed from the neck and hence once used, the apparatus would have no further use and would be disposed of.

24 Claims, 6 Drawing Sheets

(56) References Cited

U.S. PATENT DOCUMENTS

| | | | | |
|---|---|---|---|---|
| 2016/0200491 | A1* | 7/2016 | Dubach | B65D 51/222<br>222/83 |
| 2018/0319550 | A1* | 11/2018 | Costa | B65D 41/0471 |

* cited by examiner

FIG. 9
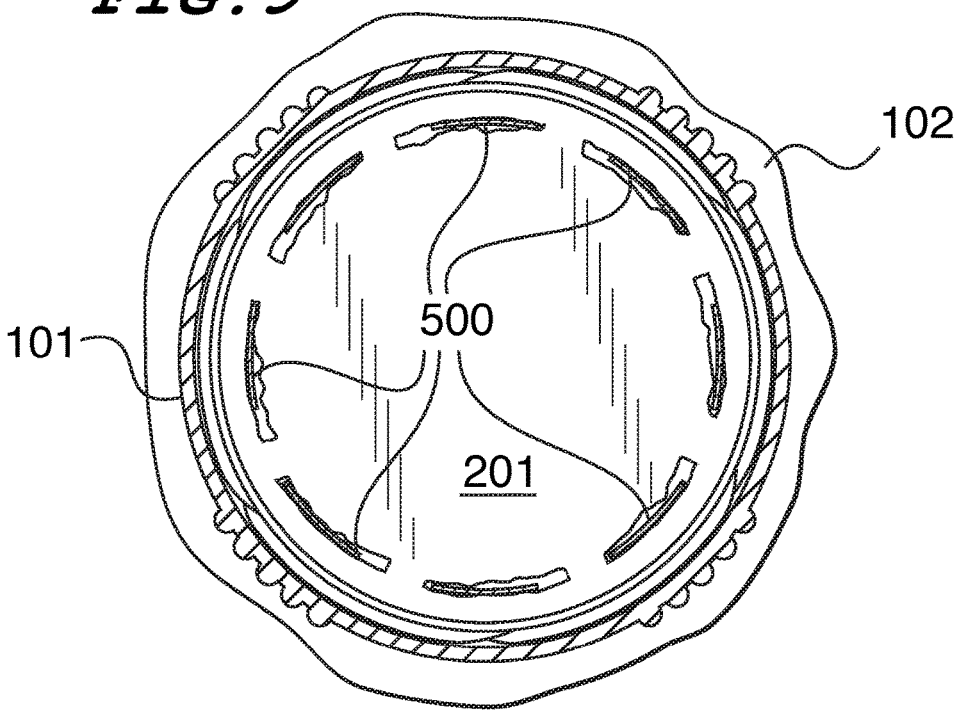
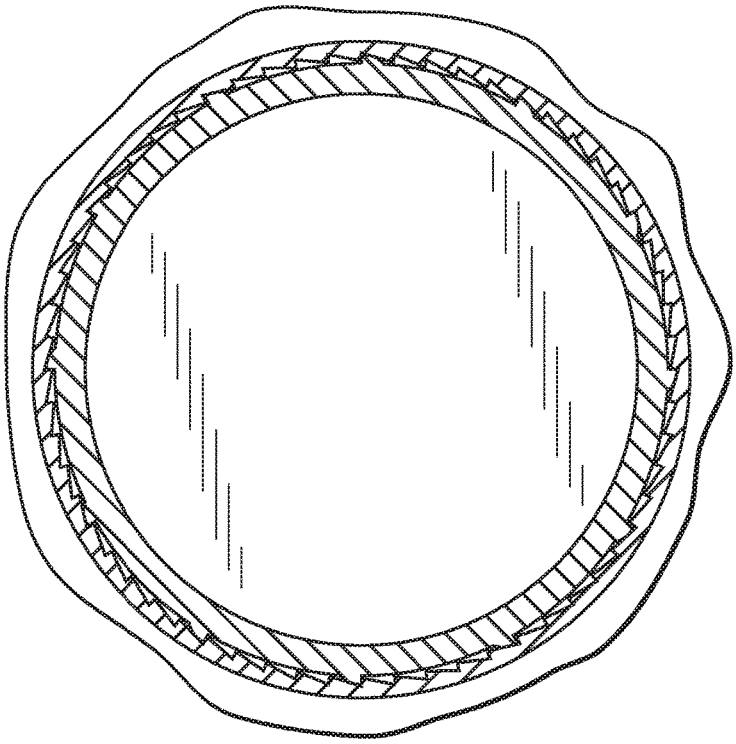
FIG. 10

ONE TIME USE BOTTLE

CROSS REFERENCE TO RELATED APPLICATIONS

This application is a continuation in part application of U.S. application Ser. No. 14/818,888, which is incorporated by reference herein in its entirety.

BACKGROUND OF THE INVENTION

Field of the Invention

The present general inventive concept is directed to a method and apparatus to provide a non-spill cup ideal for children's use.

Description of the Related Art

"Sippy cups" exist which are design to prevent spillage when the cup is positioned horizontally (e.g., spilled).

SUMMARY OF THE INVENTION

It is an aspect of the present invention to provide an improved cup.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 9 is a drawing of a cross section of the apparatus in the unsealed state, according to an embodiment; and FIG. 10 is a drawing of a cross section of the apparatus in the unsealed state, according to an embodiment.

DESCRIPTION OF THE PREFERRED EMBODIMENTS

Figure 1:
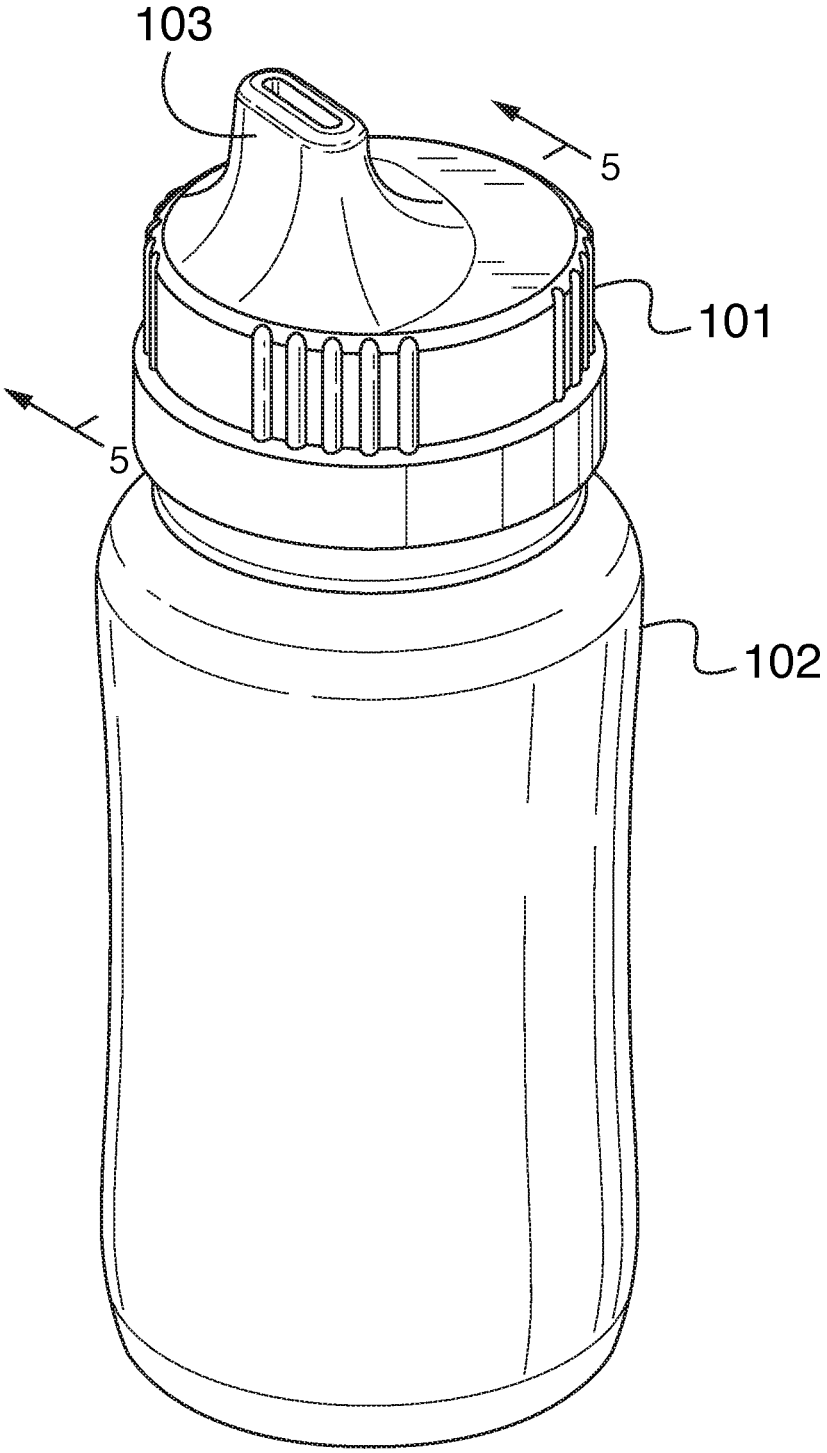
FIG. 1 is a drawing of a bottle attached to a lid, according to an embodiment.

Reference will now be made in detail to the presently preferred embodiments of the invention, examples of which are illustrated in the accompanying drawings, wherein like reference numerals refer to like elements throughout.

The present inventive concept relates to a "sippy cup" in which the contents will not leak out when the cup is spilled. Numerous mechanisms have been proposed to prevent spillage. See U.S. priority application Ser. No. 14/818,888 (which is incorporated by reference in its entirety, and all features described therein can be combined with any embodiment described herein).

The present inventive concepts utilizes a "one time use" bottle which can use the no-spill mechanism described in Ser. No. 14/818,888 (which is incorporated by reference herein in its entirety). The one-time use feature means that the user can typically utilize the cap (which incorporates the no-spill mechanism) only once and then would discard the entire apparatus (the cup, cap, and associated parts). The lid has a mechanism which restricts its use to only one use and hence would make it difficult for a user to re-use the apparatus. As such, the apparatus would be considered disposable as once used (with no liquid remaining in the bottle) a user would typically have no further use for the apparatus and would likely dispose of it. It would be very difficult for a user to put a liquid into the bottle as the spout typically would not allow for a quick flow of fluid into the bottle. Thus, users would typically purchase a larger quantity of such apparatuses (e.g., the entire bottles including the lid, etc.)

The bottle is filled with a liquid, the liner is applied, the lid is assembled onto the bottle and then the entire apparatus can be sealed (e.g., shrink wrapped) and sold in stores to users. A user would (after unwrapping it) twist the cap in one direction to unseal (open) the liquid contents already inside the bottle. The contents can then be drunk, and then the entire apparatus (e.g., bottle, lid and associated parts) can then be discarded. The lid would have a mechanism which prevents the lid (also referred to as cap) from being removed so that the user could not re-use the bottle. Once the bottle is empty, the user would not be able to remove the lid to refill it and hence would typically utilize another such bottle. The user can be a parent utilizing the bottle for a child, or the user can be the drinker himself/herself.

FIG. 1 is a drawing of a bottle attached to a lid, according to an embodiment.

A lid 101 is attached to a bottle 102. A spout 103 can utilize the no-spill mechanism described in U.S. application Ser. No. 14/818,888 (which is incorporated by reference herein in its entirety). The bottle would initially be sold in the sealed position, meaning that the liquid contents already present inside the bottle are sealed in via a liner (not shown in FIG. 1). Thus, the liquid contents cannot leak out or be drunk while the bottle is in the sealed position.

Figure 2:
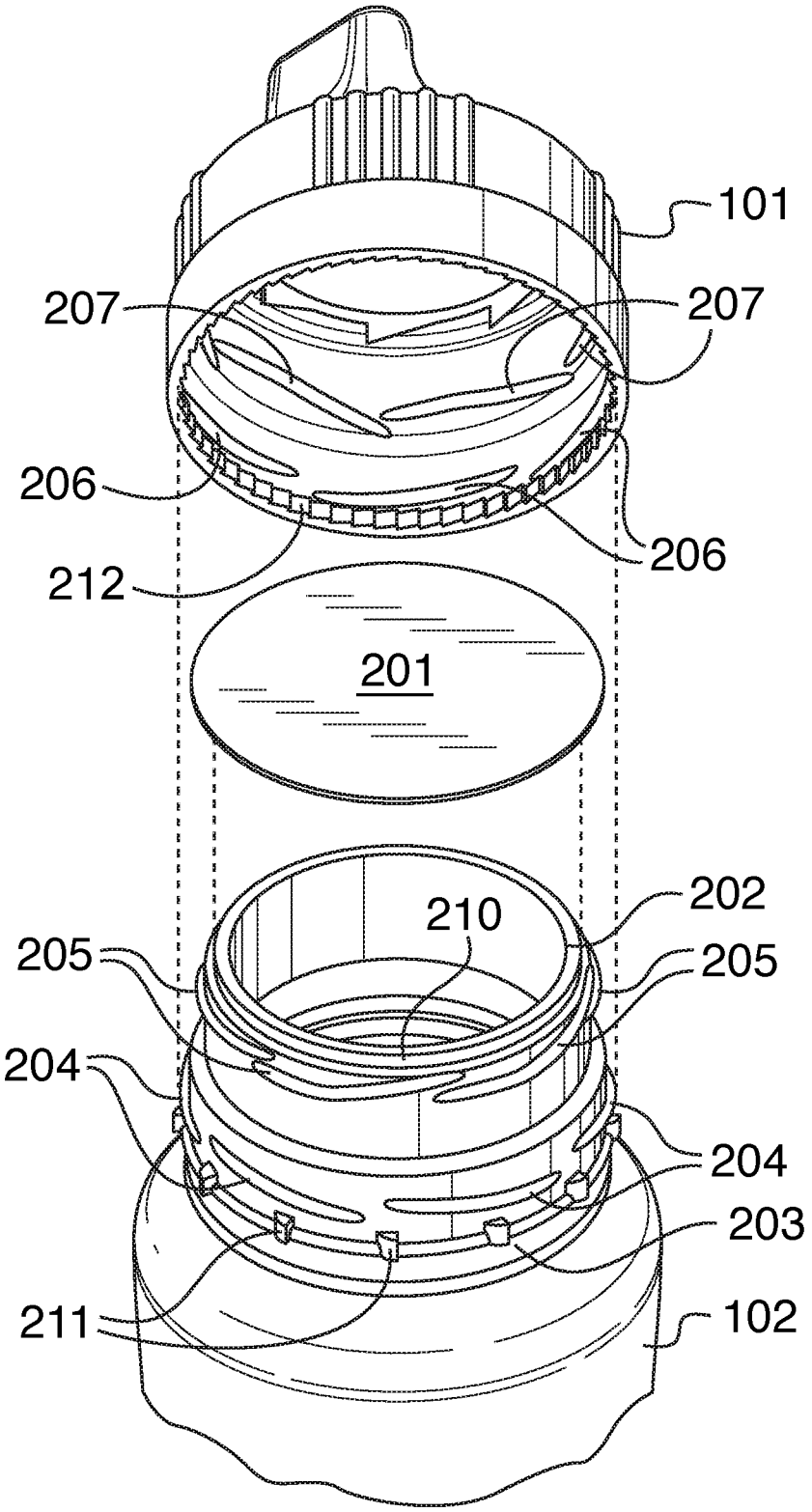
FIG. 2 is a drawing of an exploded view showing how the cap, liner, and cup all fit together, according to an embodiment.

FIG. 2 is a drawing of an exploded view showing how the cap, liner, and cup all fit together, according to an embodiment.

When assembled, a liner 201 is positioned between the lid 101 and the bottle 102. A neck 203 is present on the bottle 102, and a seat 202 is used to receive the liner 201. The liner 201 is attached to the seat 202 in one embodiment using any non-toxic adhesive (e.g., glue, rubber cement, etc.) so that the contents of the bottle are hermetically sealed from the outside via the liner. No air can pass through the liner (before the liner is cut as discussed below) or around the liner when sealed around the seat 202. Before the liner 201 is sealed around the seat 202 (via adhesion), the bottle 102 is filled with a liquid (e.g., water, juice, milk, etc.) and the remaining space in the bottle (e.g., air on top) can optionally be removed via vacuum packing. The liner 201 can be made of aluminum foil, vinyl, plastic, an oxygen barrier film, polypropylene or similar material, or other material which is not permeable. In one embodiment, the liner 201 can be sealed to the seat 202 using a chemical adhesive (e.g., non-toxic glue, etc.) In another embodiment, the liner 201 is not sealed onto the seat 202 using a chemical adhesive and instead attached to the seat 202 using a heat bond. For example, heat can be applied to the liner (e.g., hot plate, heat substrate, heat or sonic weld, etc.) and pressed onto the seat 202, the heat would cause the portion of the (polypropylene or other suitable material) liner 201 covering the seat 202 to melt thereby causing an airtight adhesion (bonding) between the liner 201 and the seat 202. The liner 201 can also be aluminum foil and it can be tightly wrapped around the seat 202 so that air cannot pass from outside of the liner into the bottle. In an embodiment, a foil liner also has a fine polymer laminate (also known as poly laminate) layer on the bottom of the foil (foil polymer laminate) and is pressed onto the top of the neck and heat is applied so that the polymer laminate layer on bottom of the foil is activated (by the heat) and bonds (seals) to the seat 202. All ways that the liner 201 is applied to the seat 202 are airtight and liquid tight seals and will only release liquid from the bottle into the lid when the liner is cut by cutters 500 as described herein. In addition to the materials described herein, the liner can be made out of any other material that keeps out oxygen (and liquids) and can be applied using any mechanism (e.g., sonic welding, heat activated, or any other adhesion method) which would keep products inside the bottle fresh and inhibit extend shelf life by completely sealing the contents inside the bottle.

Note that the liner can come in large rolls (e.g., 36" wide and 250 feet long). In an embodiment, the liner can be precut into circles which fit onto the seat 202 and are applied to the seat using any method described herein. In another embodiment, the liner can be (from its original roll) stamped onto a plurality of bottles with heat applied (or other sealing mechanism such as an ultrasonic horn punch) in order to seal the liner onto each bottle (seat 202). So in other words, in this embodiment the liner is stamped (punched) onto the seat 202 of a plurality of bottles off its original roll and sealed using any sealing mechanism used herein.

After the liner 201 is hermetically sealed to the seat 202 (and hence the neck 203) the lid 101 can then be screwed onto the neck 203 into the sealed position. The bottle is now ready to be sealed and sold to a user.

The neck 203 also comprises a liner clearance 210. This is a surface circumscribing the neck 203 in which the liner 201 (if it is a malleable material such as aluminum foil) can be bent and "formed" around to enable an airtight seal.

The lid 101 comprises lid assembly threads 207 and lid opening threads 206. The neck 203 of the bottle 102 comprises neck assembly threads 205 and neck opening threads 204. The lid assembly threads 207 cooperate (e.g., pass through) with the neck assembly threads 205 and the lid opening threads 206 cooperate (e.g., pass through) with the neck opening threads 204. The lid assembly threads 207 and the neck assembly threads 205 cooperate to enable the lid 101 to be screwed (in a clockwise direction) from the pre-assembled state (see FIG. 3) around the neck 203 into the sealed state.

The lid opening threads 206 and the neck opening threads 204 cooperate to enable the lid 101 to be screwed (when in the sealed state) around the neck 203 in a counterclockwise direction to put the apparatus in the unsealed state. The lid opening threads 206 and the neck opening threads 204 also prevent the lid from being further rotated in the clockwise direction once in the sealed state.

Note that the neck has anti-backoff notches 211 and the lid has anti-backoff ratchet 212. The notches 211 engage with the ratchet 212 when the lid is fully sealed and the foil has been pierced. This keeps the cap sealed against the bottle to prevent leaking and thus prevents the user from turning the lid clockwise to remove (unseal) the lid 101. The notches 211 are slanted such that they will stick inside the ratchet 212 thereby preventing a clockwise motion (when engaged) but not preventing a counter-clockwise motion (to open the bottle and pierce the liner (e.g., foil).

All rotational directions (i.e., clockwise, counterclockwise) are from the reference of looking at the apparatus from above the apparatus (e.g., looking down at the top/lid). Note that in another embodiment, all directions can be reversed (that is, instead of the rotations operating as stated herein, the threading can be configured to operate in the reverse direction (e.g., all "clockwise" herein can be "counter clockwise" and all "counter clockwise" can be "clockwise").

Figure 3:
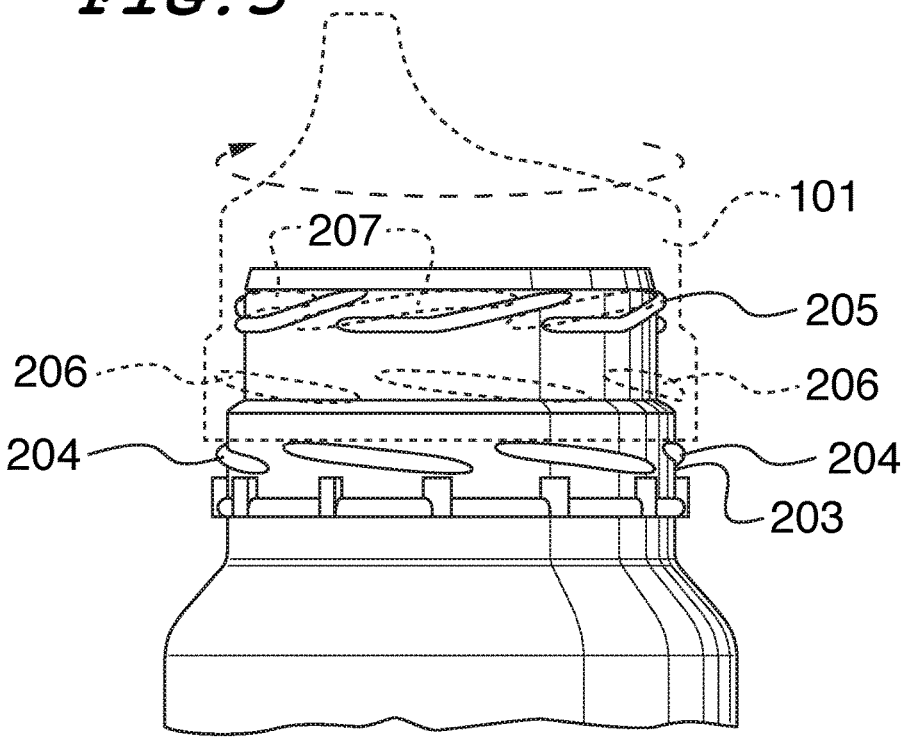
FIG. 3 is a drawing showing a pre-assembled state of the apparatus, according to an embodiment.

FIG. 3 is a drawing showing a pre-assembled state of the apparatus, according to an embodiment. The pre-assembled state is where the lid 101 is placed onto the neck 203 but is not yet in the sealed state. The apparatus should typically only be shipped with it is in the sealed state (with liquid inside the bottle). Of course, in the sealed state, the liquid inside the bottle is safe and will not leak out due to the liner 201 which is affixed tightly (air tight and liquid tight) to the seat 202 on the neck 203.

Once the bottle is filled with liquid, and the liner is placed on, the apparatus should now be assembled. The lid 101 is screwed on the neck 203 in a clockwise direction as shown in FIG. 3 putting the apparatus into the sealed state (see FIG. 4). As the lid is being screwed on to the neck 203 the lid opening threads 206 will first engage the neck assembly threads 205 and then with continued clockwise rotation the lid assembly threads 207 will then engage the neck assembly threads 205 eventually putting the lid/apparatus into the sealed state (see FIG. 4). Note that the neck assembly threads 205 can be "V" shaped in order to engage the lid assembly threads 207 (which have an upside down "V" shape) to prevent the user from now turning the lid 101 counterclockwise while lifting the lid in order to remove the lid 101. Note that being "v-shaped" or "upside down V shaped") does not mean that it has to be a perfect "V" or symmetrical but just that the thread is not straight and forms an angle that generally points upward ("V-shaped") or downward ("upside down V-shaped").

Note that the liner 201 is what keeps the contents inside the bottle airtight, not the lid 101 (as air may possible pass through the spout and through the lid 101 but will not pass through (or around) the liner 201.

Figure 4:
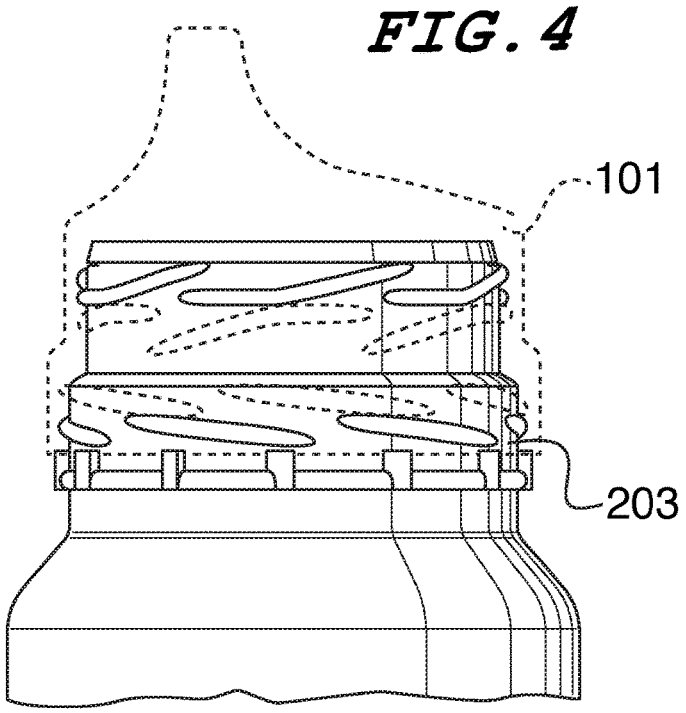
FIG. 4 is a drawing showing a sealed state of the apparatus, according to an embodiment.

FIG. 4 is a drawing showing a sealed state of the apparatus, according to an embodiment.

From the pre-assembly state illustrated in FIG. 3, turning the lid clockwise now brings the lid (and hence apparatus) into the sealed state (in which the contents in the bottle are still airtight and cannot be drunk but the apparatus is ready to be shipped/sold). In the sealed state, the lid 101 cannot now be easily removed. The lid cannot now (in the sealed state) be rotated in a clockwise direction any further as the opening threads (the lid opening threads 206 and the neck opening threads 204) prevent further rotation in the clockwise direction.

From the sealed state in FIG. 4, the lid 101 (and hence the apparatus) can be converted into the unsealed state (see FIG. 7) by rotating the lid counterclockwise which pierces the liner by the cutters 500. Note that typically in the sealed state the lid cannot now be rotated clockwise because the lid opening threads 206 and the neck opening threads 204 would prevent further rotation in the clockwise direction (although a slight clockwise motion may be possible until the lid opening threads 206 and the neck opening threads 204 engage tightly thereby preventing further clockwise rotation).

Figure 5:
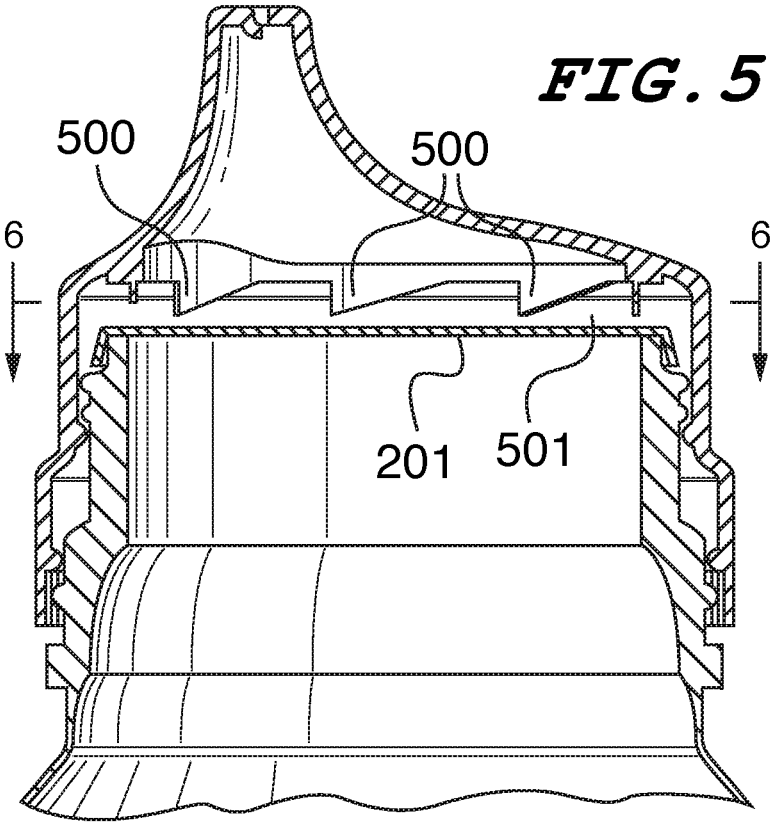
FIG. 5 is a drawing of a cross section of the apparatus in the sealed state, according to an embodiment.

FIG. 5 is a drawing of a cross section of the apparatus in the sealed state, according to an embodiment. The cross section is taken from the view marked '5' in FIG. 1.

Shown are a plurality of cutters 500 (also shown in FIG. 1) which are located around the perimeter inside the lid 101. The cutters are located around the entire circumference of the inside of the lid 101 (even though only three cutters are shown in FIG. 5). There is a clearance area 501 between the bottom of the cutters 500 and the liner 201. This clearance area 501 is a buffer between the cutters 500 and the liner 201 so that the cutters 500 do not contact the liner 201 until the lid 101 is rotated counter clockwise which would then cause the cutters 500 to lower onto the liner 201 and cut the liner 201. Each cutter 500 should typically have a sharp edge which lowers into the liner 201 to enable the cutter to easily puncture the liner 201 and cut it as the cutters 500 rotate along with the lid rotation when the lid is being put into the unsealed position (from the sealed position). The cutters can be made out of plastic or any other suitable material.

Note that the liner 201 in this embodiment is made out of aluminum foil (or any other type of foil) and is wrapped around the liner clearance 210 to make an airtight (and liquid-tight) seal around the seat 202. In one embodiment, the nature of the foil material is such that once crimped around the liner clearance 210 it will remain in place maintaining the tight seal around the seat 202 even though no chemical adhesives are used. In another embodiment, as discussed herein, the foil will have attached to it a fine polymer laminate layer on the bottom of the foil which adheres to the top of the seat 202 utilizing methods described herein (e.g., heat applicator, etc.)

Note that while a plurality of cutters 500 are shown, any other cutting apparatus can be used in this manner to cut into the liner (e.g., a cutter of cutters with a different configurations, shapes, locations, etc.)

Figure 6:
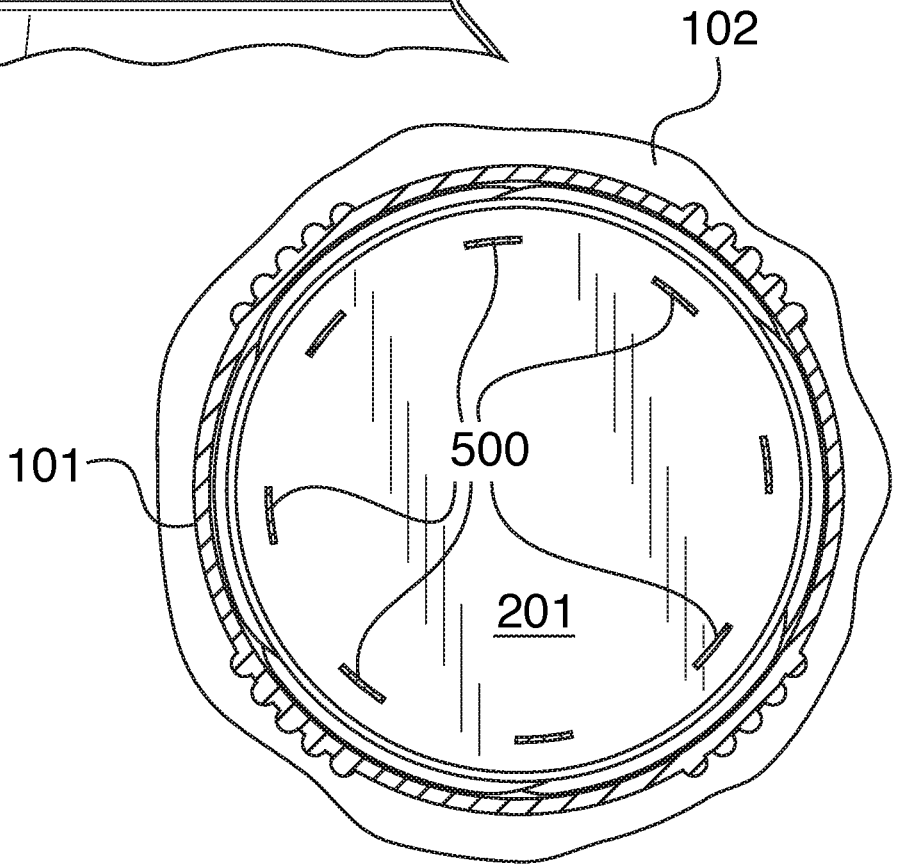
FIG. 6 is a drawing of a cross section of the apparatus in the sealed state, according to an embodiment.

FIG. 6 is a drawing of a cross section of the apparatus in the sealed state, according to an embodiment. The cross section shown in FIG. 6 is taken along the view marked '6' in FIG. 5 (in other words, looking down at the liner 201 attached to the seat 202 on the neck 203 from just above the cutters 500 on the lid 101).

The cutters 500 (which are part of the lid) are shown (all of which are typically identical in structure). The liner 201 is also shown. In the sealed state, there is the clearance area 501 between the cutters 500 and the liner 201 so that the cutters 500 are not contacting the liner 201 in the sealed state (See FIG. 5).

Figure 7:
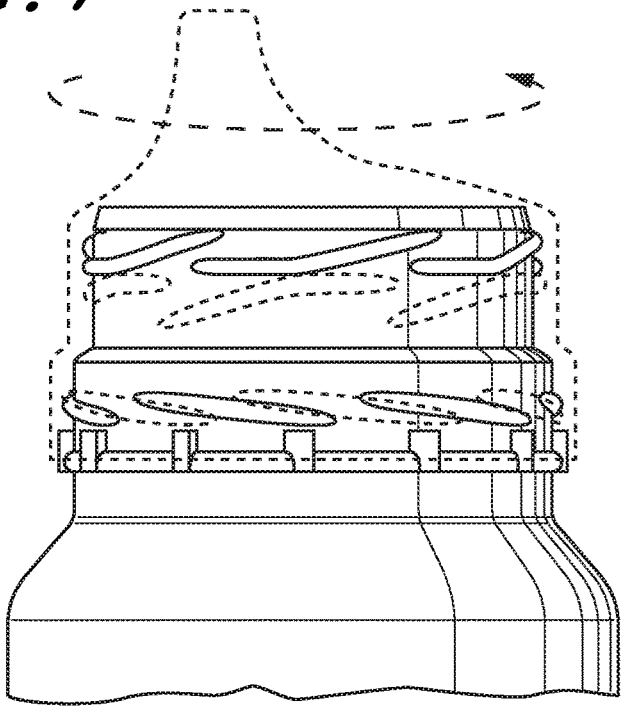
FIG. 7 is a drawing of the apparatus in an unsealed state, according to an embodiment.

FIG. 7 is a drawing of the apparatus in an unsealed state, according to an embodiment.

Turning the lid 101 counter clockwise from the sealed state (see FIG. 4) results in the apparatus being in the unsealed state. The unsealed state is where the liquid that came inside the bottle can now be drank out the spout. This is possible because during the process of turning the lid 101 counter clockwise, the cutters 500 will be lowered into the liner 201 and cut the liner 201 thereby enabling liquid to flow through these cuts in the liner through the inside of the neck and through the spout.

As the lid is turned counter clockwise by the user, eventually the lid is prevented from continuing to turn counter clockwise due to the structure of lid opening threads 206 and neck opening threads 204. In other words, the lid can be rotated counter clockwise up to a certain point upon which it will not rotate counter clockwise any longer. The lid 101 forms a tight mechanical seal with the neck 203 by virtue of screwing onto the threads thereby preventing any liquid from leaking out of the lid (except of course through the spout 103. The lid assembly threads 207 tighten with the neck assembly threads 205 and the lid opening threads 206 tighten with the neck opening threads 204 thereby sealing (preventing) the lid and neck from leaking fluid out. The anti-backoff notches 211 on the neck and the anti-backoff ratchet 212 on the lid also serves to prevent leakage out between the neck and the lid by preventing backoff (preventing a clockwise motion to loosen the lid) thereby keeping the lid sealed onto the neck.

Once the apparatus is in the unsealed state, it cannot be put back into the sealed state as the liner 201 is already cut (enabling fluid flow) and cannot be restored.

Compare FIG. 7 (unsealed, or open which allows the liquid to flow) vs. FIG. 4 (sealed, or closed which prevents the liquid from flowing). In FIG. 7, the lid is lower than it is in FIG. 4 because turning the lid counterclockwise in the sealed position lowers the lid onto the neck. Note that in the sealed position the lid rests on the neck with the lid opening threads resting on the neck opening threads. Thus, without a counterclockwise rotational force, the lid will remain resting on the neck in the sealed position.

Figure 8:
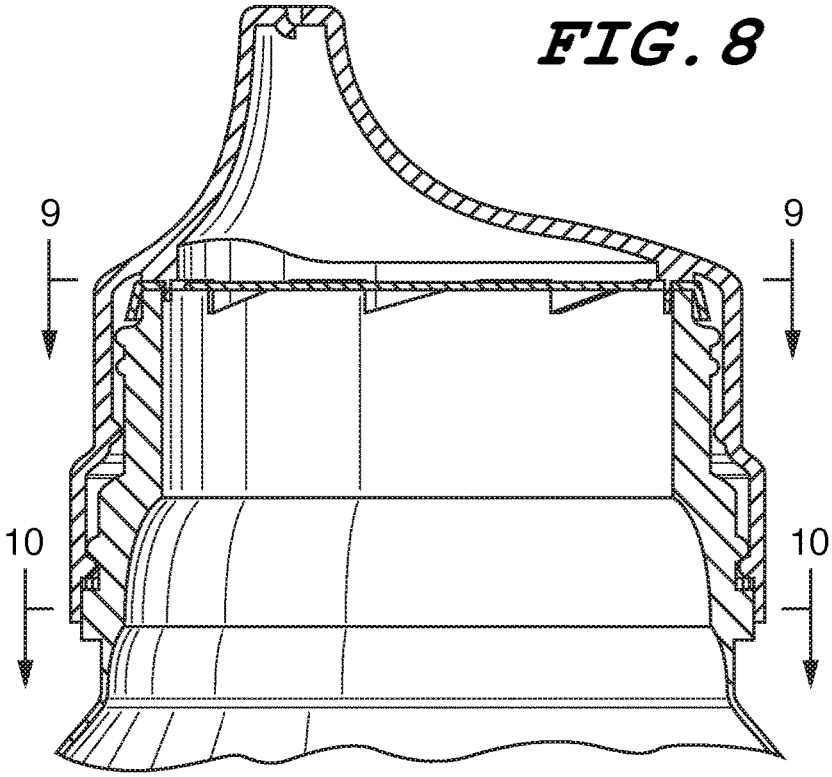
FIG. 8 is a drawing of a cross section of the apparatus in the unsealed state, according to an embodiment.

FIG. 8 is a drawing of a cross section of the apparatus in the unsealed state, according to an embodiment.

As can be seen in FIG. 8, the line is cut by the cutters and the lid is now in the unsealed state (lower position). The sealed state can be considered the middle position, and the assembly state can be considered the raised position.

FIG. 9 is a drawing of a cross section of the apparatus in the unsealed state, according to an embodiment. FIG. 9 is a cross section taken at the view marked '9' in FIG. 8.

The liner 201 is shown cut in eight places but the eight cutters 500 (although of course there can be any number of cutters). Each cutter has sliced a slit (or hole) into the liner 201 which is large enough to allow the fluid to flow through. Note that the liner does not fall through or get cut out completely, the holes cut into the liner by the cutters 500 (as illustrated) are adequate to now enable fluid to flow from the inside of the bottle through the lid (and out the spout) through the holes in the liner 201. The holes in the liner restrict movement of the fluid and restricts flow of liquid coming out of the bottle into the lid thereby helping prevent leakage out of the lid/neck.

FIG. 10 is a drawing of a cross section of the apparatus in the unsealed state, according to an embodiment. FIG. 10 is a cross section taken at the view marked '10' in FIG. 8.

Note that in the figures all parts not shown (unless stated otherwise) would typically follow the pattern as already shown in the drawings. For example, in FIG. 2, the threads 203 would continue around the entire circumference of the neck (even though the entire nick is not visible in FIG. 2).

The bottle can be made out of Polyethylene terephthalate (PET) or polypropylene or other suitable materials (the bottle can be clear or opaque). The cap can be made out of polypropylene or other suitable materials. All parts described herein can be made out of any suitable material, including (but not limited to) plastic, vinyl, rubber, any material described herein, any suitable material used in the art, etc. In another embodiment, the liquid stored inside the bottle does not have to be a drinkable liquid but instead can be used to store non-drinkable liquids (e.g., chemicals, weed killer, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

a bottle comprising a neck;

a lid comprising a cutting apparatus;

a pair of cooperating assembly threads comprising lid assembly threads on an upper part of the lid and neck assembly threads on an upper part of the neck; and a pair of cooperating opening threads comprising lid opening threads on a lower part of the lid and neck opening threads on a lower part of the neck, wherein the lid and the neck are not a same piece, wherein the pair of cooperating assembly threads are structured to lower the lid on the neck in a first rotational direction, and the pair of cooperating opening threads are structured to lower the lid on the neck in a second rotational direction, the second rotational direction being opposite the first rotational direction.

2. The apparatus as recited in claim 1, further comprising a liner sealed onto a seat on a top of the neck.

3. The apparatus as recited in claim 2, further comprising a clearance area between the liner and the cutting apparatus.

4. The apparatus as recited in claim 1, wherein the cutting apparatus comprises a plurality of cutters.

5. The apparatus as recited in claim 4, wherein each of the plurality of cutters comprises a sharp point.

6. The apparatus as recited in claim 4, wherein the plurality of cutters are circularly arranged around the lid.

7. The apparatus as recited in claim 6, wherein the plurality of cutters are located above the lid assembly threads.

8. The apparatus as recited in claim 2, further comprising a drinkable liquid sealed inside the bottle.

9. The apparatus as recited in claim 2, wherein the liner is made of aluminum foil.

10. The apparatus as recited in claim 9, wherein the liner made of foil has a polymer laminate layer on a bottom of the liner.

11. The apparatus as recited in claim 2, wherein the liner is made out of polypropylene.

12. The apparatus as recited in claim 1, wherein each of the neck assembly threads are v-shaped.

13. The apparatus as recited in claim 12, wherein the lid assembly threads are shaped in an upside-down v-shape.

14. An apparatus, comprising:

a bottle comprising a neck and a liner sealed over the neck;

a lid comprising cutters;

a pair of cooperating assembly threads comprising lid assembly threads on an upper part of the lid and neck assembly threads on an upper part of the neck, the pair of cooperating assembly threads configured to lower the lid onto the neck and attach the lid to the neck; and a pair of cooperating opening threads comprising lid opening threads on a lower part of the lid and neck opening threads on a lower part of the neck, the pair of cooperating opening threads configured to lower the lid on the neck causing the cutters to cut into the liner, wherein the lid and the neck are not a same piece wherein a rotational direction used by the pair of cooperating assembly threads to lower the lid on the neck is an opposite direction from a rotational direction used by the pair of cooperating opening threads to lower the lid on the neck.

15. An apparatus, comprising:

a bottle comprising a neck and a liner sealed over the neck;

a lid comprising cutters;

a pair of cooperating assembly thread comprising lid assembly threads on an upper part of the lid and neck assembly threads on an upper part of the neck, the pair of cooperating assembly threads configured to lower the lid onto the neck and attach the lid to the neck; and at pair of cooperating opening threads comprising lid opening threads on a lower part of the lid and neck opening threads on a lower part of the neck, the pair of cooperating opening threads configured to lower the lid on the neck causing the cutters to cut into the liner, wherein the lid and the neck are not a same piece; and anti-backoff notches on the neck and an anti-backoff ratchet on the lid both configured to prevent the lid from being removed from the neck by preventing rotation in a rotational direction used by the pair of cooperating assembly threads.

16. A method, comprising:

possessing:

a bottle comprising a neck;

a lid comprising a cutting apparatus;

a pair of cooperating assembly threads comprising lid assembly threads on an upper part of the lid and neck assembly threads on an upper part of the neck;

a pair of cooperating opening threads comprising lid opening threads on a lower part of the lid and neck opening threads on a lower part of the neck, wherein the lid and the neck are not a same piece;

wherein a rotational direction used by the pair of cooperating assembly threads to lower the lid on the neck is an opposite direction from a rotational direction used by the pair of cooperating opening threads to lower the lid on the neck;

filling the bottle with a liquid;

sealing a seal onto the neck; and rotating the lid onto the neck thereby causing the lid to be in a sealed position.

17. The method as recited in claim 16, further comprising:

rotating the lid onto the neck thereby causing the cutting apparatus to cut into a liner sealed over the neck thereby exposing the liquid.

18. An apparatus, comprising:

a bottle comprising a neck and a liner sealed over the neck;

a lid comprising cutters;

a first means for lowering the lid onto the neck and attaching the lid to the neck; and a second means for lowering the lid onto the neck thereby cutting into the liner with the cutters, wherein a rotational direction used by the first means to lower the lid on the neck is an opposite direction from a rotational direction used by the second means to lower the lid on the neck.

19. The apparatus as recited in claim 18, further comprising anti-backoff means to prevent the lid from being removed from the neck.

20. The apparatus as recited in claim 1, further comprising:

anti-backoff notches on the neck; and an anti-backoff ratchet on the lid.

21. The apparatus as recited in claim 14, wherein the neck and the lid are further configured such that after the cutters have cut into the liner, further rotation is prevented in the rotational direction used by the pair of cooperating opening threads due to the lid forming a tight mechanical seal with the neck.

22. The apparatus as recited in claim 15, wherein the neck and the lid are further configured such that after the cutters have cut into the liner, further rotation is prevented in a rotational direction used by the pair of cooperating opening threads due to the lid forming a tight mechanical seal with the neck.

23. The apparatus as recited in claim 3, wherein the liner is made out of aluminum foil and is wrapped around the clearance area making an airtight and liquid-tight seal.

24. The apparatus as recited in claim 15, wherein a rotational direction used by the pair of cooperating assembly threads to lower the lid on the neck is an opposite direction from a rotational direction used by the pair of cooperating opening threads to lower the lid on the neck.

* * * * *